United States Patent [19]

Baseman et al.

[11] Patent Number: 4,687,634

[45] Date of Patent: Aug. 18, 1987

[54] PROCESS FOR INHIBITING CORROSION OF METAL SURFACES

[75] Inventors: Maurice Baseman, Pittsburgh; Harold Swift, Gibsonia, both of Pa.

[73] Assignee: Ronco Laboratories, Inc., Pittsburgh, Pa.

[21] Appl. No.: 925,789

[22] Filed: Oct. 31, 1986

[51] Int. Cl.[4] ..... C23F 11/00; C04B 9/02

[52] U.S. Cl. ..... 422/7; 106/14.29; 106/14.31

[58] Field of Search ..... 106/14.24, 14.31; 422/7

[56] References Cited

U.S. PATENT DOCUMENTS 2,330,524 9/1943 Shields ..... 106/14.31

2,784,104 3/1957 Baseman et al. ..... 106/14.31

2,829,945 4/1958 Krieg ..... 106/14.31

*Primary Examiner*—Theodore Morris

*Attorney, Agent, or Firm*—Joseph J. Carducci

[57] ABSTRACT

A process for inhibiting corrosion of metal surfaces, such as steel, in a closed system which comprises maintaining in such system a composition containing a major amount of an oleaginous vehicle, such as petroleum hydrocarbon, and minor amounts of an oil-soluble hydrophilic cosolvent, such as a wetting agent, and the reaction product of substantially equimolar proportions of a dicyclohexylamine, such as dicyclohexylamine itself, and a $C_7$ organic acid, such as heptanoic acid and cyclohexane carboxylic acid, wherein such heptanoic acid is preferably obtained by the oxidation of $C_7$ aldehydes resulting from the oxonation of $C_6$ alpha olefins.

19 Claims, No Drawings

PROCESS FOR INHIBITING CORROSION OF METAL SURFACES

BACKGROUND OF THE INVENTION

1. Field of the Invention

This invention relates to a process for inhibiting corrosion of metal surfaces in a closed system which comprises maintaining in said system a composition containing (1) a major amount of an oleaginous vehicle and minor amounts of (2) an oil-soluble hydrophilic cosolvent and (3) the reaction product of substantially equimolar proportions of (a) a dicyclohexylamine and (b) a $C_7$ organic acid.

2. Description of the Prior Art

The surfaces of metallic components in a closed system are susceptible to corrosion upon standing over a long period of time. For example, in an automotive engine, when not in use for a period of time, as when the same is being transported, the inner surfaces thereof can be corroded because of the condensation of water thereon or, if the engine has previously been operated, because of the acidic corrosion materials produced therein. It is common in shipping or storing many items having metallic parts, such as heat exchangers, pipes, hydraulic cylinders, automotive parts, machine tools, automobile engines, etc., to coat the same with a mineral oil and then wrap the coated item to form a closed container to reduce corrosion. However, in such instances, again water of condensation and/or acidic products in the container will tend to corrode the metallic portions of such items, despite the presence of the mineral oil on the surfaces thereof.

In U.S. Pat. No. 2,784,104, Baseman et. al. wish to displace water from a metal surface by applying corrosion-inhibiting coatings thereon, said coatings comprising a major portion of an oleaginous vehicle and minor amounts of an oil-soluble hydrophilic agent and the reaction product of dicyclohexylamine and octanoic acid.

We have found in the present invention that the susceptibility of a metal surface in a closed system to corrosion in the presence of condensed water or in an atmosphere containing acidic components, for example, from the combustion of a fuel, such as gasoline, can be inhibited or substantially reduced without the need to coat the same with an oleaginous vehicle, such as a mineral oil, by the mere expedient of maintaining in said closed sytem, without need of contacting the metal surface, a composition containing a major amount of an oleaginous vehicle and minor amounts of an oil-soluble hydrophilic cosolvent and the reaction product of substantially equimolar proportions of a dicyclohexylamine and a $C_7$ organic acid.

SUMMARY OF THE INVENTION

In accordance with the invention defined and claimed herein the tendency of a metal surface in a closed system to corrode can be greatly reduced, and in most cases completely obviated, by the simple expedient of maintaining in said closed system a novel composition containing a major amount of an oleaginous vehicle and minor amounts of an oil-soluble hydrophilic cosolvent and the reaction product of substantially equimolar proportions of a dicyclohexylamine and a $C_7$ organic acid.

The first component of the novel composition used in the claimed novel process herein is any oleaginous vehicle that will serve as a solvent for the reaction product of substantially equimolar proportions of a dicyclohexylamine and a $C_7$ organic acid. The oleaginous vehicle is preferably a relatively non-volatile fluid having a viscosity between about 60 to about 1000 saybolt universal seconds (SUS), preferably between about 100 to about 200 SUS, at 25° C. Suitable oleaginous vehicles include petroleum hydrocarbon oils, such as paraffinic and naphthenic oils; vegetable oils, such as castor oil; and synthetic oils, such as long chain esters of dibasic acids, for example, bis (2-ethylhexyl) sebacates, and the like, and neopentyl polyoils, known as Mobil Jet Oil II, sold by Mobil Oil Corportion.

Any oil-soluble hydrophilic cosolvent in which the reaction product of substantially equimolar proportions of a dicyclohexylamine and a $C_7$ organic acid will dissolve can be employed as the second component in the novel composition used herein. Particularly effective as cosolvents for use herein are oil-soluble hydrophilic wetting agents. Petroleum sulfonates or mahogany soaps, of which sodium barium mahogany sulfonates are examples, are quite satisfactory. Sorbitan monolaurate, sorbitan monopalmitate, sorbitan monooleate and sorbitan monopalmitate polyoxyethylene derivatives, sold as Tweens, are other suitable wetting agents. The oil-soluble hydrophilic wetting agents are especially effective as cosolvents, particularly when the first component herein is a paraffinic mineral oil, as an acid in dissolving the reaction product of substantially equimolar proportions of a dicylohexylamine and a $C_7$ organic acid.

The third component of the composition used in the process claimed herein is the reaction product of substantially equimolar proportions of a dicyclohexylamine and a $C_7$ organic acid. It is critical that the third component be prepared using a $C_7$ organic acid in the reaction with the dicyclohexylamine. When higher aliphatic acids, such as octanoic acid, are used, for example, as in said U.S. Pat. No. 2,784,104, we have found that in the process claimed herein the metal surfaces still have a tendency to corrode. If lower aliphatic acids, that is, having less than seven carbon atoms, are used, the reaction product will not easily solubilize in the cosolvents used herein and will therefore be unusable. In addition, such lower acids, and their reaction products, have such objectionable odors as to make their use impractical. We believe that it is critical that a $C_7$ organic acid be used, because our invention requires that the reaction product of the acid used in the reaction with the dicyclohexylamine result in the production of a volatile corrosion inhibitor which can then escape from the oleaginous vehicle of the novel composition used and will diffuse onto the surfaces of the metal to displace and/or react with the water or acidic components on the metal surface and therefore inhibit corrosion thereof. On the other hand, the reaction product produced using a higher aliphatic acid has less tendency to volatilize, while that of a lower carbon atom aliphatic acid will have difficulty in solubilizing itself in the composition and therefore will not be able to volatilize. In preparing the desired reaction product straight, branched, or cyclical or mixtures of such $C_7$ organic acids can be used. We prefer, however, to use straight chain heptanoic acids obtained from the oxidation of $C_7$ aldehydes resulting from the oxonation of $C_6$ alpha olefins obtained from the oligomerization of ethylene, particularly using a Ziegler catalyst.

The dicyclohexylamines that can be used herein in the reaction with the $C_7$ organic acids can be defined by the following structural formula:

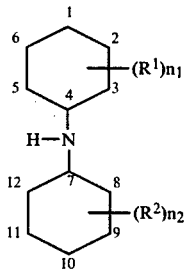

wherein $R^1$ and $R^2$, the same or different, can be selected from the group consisting of hydrogen, normal and branched alkyls having from 1 to 6 carbon atoms, preferably methyl, cyclic alkyls, and phenyl, and $n_1$ and $n_2$, the same or different, can be integers ranging from 1 to 10, preferably from 1 to 5. Specific examples of dicyclohexylamines that can be used include dicyclohexylamine (DCHA), 2-methyl DCHA, 3-isopropyl DCHA, 1-phenyl DCHA, 2,2-dimethyl DCHA, 10-isobutyl DCHA, 1,10-diethyl DCHA, 2-hexyl DCHA, 12-isopropyl DCHA, 1-methyl, 8-ethyl DCHA, 3-pentyl, 11-ethyl DCHA, 1-methyl, 5-cyclohexyl DCHA,1,3,7-trimethyl DCHA, 1,2,3,8,10,11-hexamethyl DCHA, etc.

The reaction product of substantially equimolar proportions of a dicyclohexylamine and a $C_7$ organic acid is readily produced by mixing the two ingredients at room, or ambient, temperatures, for example 25° C. Although any isomer, including cyclical isomers, such as cyclohexane carboxylic acid, or mixtures of a $C_7$ organic acids can be used, best results are obtained using normal heptanoic acid. The proportions, in the preferred embodiment, comprise approximately 43 grams of the heptanoic acid and 57 grams of dicyclohexylamine. The reaction is complete in a short time, for example, in about ten minutes, with evolution of heat, and produces a crystalline reaction product. The reaction product can be dissolved in a small amount of an organic solvent, for example, kerosene or xylol and then added to the oleaginous vehicle. If desired, the reaction product can be produced in situ directly in the oleaginous vehicle.

The oleaginous vehicle, the hydrophilic cosolvent and the reaction product of the dicyclohexylamine and the $C_7$ organic acid can be admixed in any order. Good results have been obtained by heating the oleaginous vehicle to about 35° to about 50° C. and stirring in the reaction product of the dicyclohexylamine and the $C_7$ organic acid, the latter being dissolved in a small quantity of kerosene, and then adding the hydrophilic cosolvent.

The compostion employed herein will contain the components defined above in the following approximate weight percents.

TABLE NO. I

| | Weight Percent | |
|---|---|---|
| | Broad Range | Preferred Range |
| Oleaginous Vehicle | 99.8 to 89.0 | 99.6 to 97.0 |
| Hydrophilic Cosolvent | 0.1 to 6.0 | 0.1 to 2.0 |
| Reaction Product of the Dicyclohexylamine and the | 0.1 to 5.0 | 0.3 to 1.0 |

TABLE NO. I-continued

| | Weight Percent | |
|---|---|---|
| | Broad Range | Preferred Range |
| $C_7$ Organic Acid | | |

The metal surfaces protected by the novel process defined and claimed herein includes steel, cast iron, copper, brass and aluminum.

The novel process is simply carried out. The novel composition defined above is placed in the closed container and the reaction product of the dicyclohexylamine and the $C_7$ organic acid present therein will volatilize until the free space in the container is saturated therewith. The reaction product of the dicyclohexylamine and the $C_7$ organic acid will coat the metal surface, or if the metal surface is wet with water, will displace the same, and thereby provide a corrosion-inhibiting coating thereon. Since the free space is confined, the reaction product of the dicyclohexylamine and the $C_7$ organic acid cannot easily escape therefrom and therefore will be available for extremely long period of time, for example, up to a year, and even more, to exert its anti-corrosion properties on the metal surface. The closed system can be any system, relatively permanent, as in an internal combustion engine or semi-permanent, as in a package used in shipping metal parts.

DESCRIPTION OF PREFERRED EMBODIMENTS

The following examples illustrate the novel process defined and claimed herein.

EXAMPLE NO. I

In the bottom of a wide-mouthed glass jar having a height of four inches and a diameter of 3.5 inches, there was placed a watch glass contained four grams of a paraffinic mineral oil having a viscosity of 750 SUS at 25° C., and then 50 milliliters of distilled water. The glass jar was then closed using its screw metal top, and twirled for one minute to mix the oil and water. The screw metal top was removed and there was vertically mounted therein, adjacent a vertical portion of the glass jar, over the oil-water mixture, a polished, corrosion-free test panel made of SAE 1009 carbon steel, measuring $1\frac{1}{2}$ inches by 2 inches by $\frac{1}{8}$ inch. The test panel was mounted by means of a stainless steel metal wire having a horizontal loop at the base thereof and a hook adjacent the top thereof engageable with a hole in the test panel. The glass jar was then sealed by means of its screw metal top and placed in an oven at 54° C. for 16 hours. Following this, the glass jar was placed in a refrigerator at about 5° C. for an additional 16 hours. The test panel was found to be covered with light to heavy corrosion over the entire surface of the test panel.

EXAMPLES NOS. II TO VII

Example No. I was repeated a number of times, except that the oil-water mixture additionally contained varying amounts of the reaction product of substantially equal molar amounts of dicyclohexylamine and heptanoic acid (DCH) or dicyclohexylamine and octanoic acid (DCO) and, as a cosolvent, one weight percent, based on the oil, of sorbitan monooleate. The DCH was made as defined above using normal hexanoic acid obtained from the oxidation of the $C_7$ aldehyde resulting fron the oxonation of a $C_6$ alpha olefin obtained from the oligomerization of ethylene. The DCO was obtained from the reaction of dicyclohexylamine with normal octanoic acid at 25° C. for 10 minutes. The results obtained are tabulated below in Table No. II.

TABLE NO. II

| Example No. | Ester in Water Mixture | Weight Percent Ester Based on Total Weight of Oil-Water Mixture | Visual Appearance of Test Panel |
|---|---|---|---|
| II | DCH | 0.3 | Upper ½ rusted |
| III | DCO | 0.3 | Upper ¾ rusted |
| IV | DCH | 0.5 | Upper ⅓ rusted |
| V | DCO | 0.5 | Upper ½ rusted |
| VI | DCH | 0.7 | Corrosion free |
| VII | DCO | 0.7 | Upper ⅓ rusted |

The data above disclose the uniqueness of using controlled amounts of the reaction product ester of dicyclohexylamine and heptanoic acid in the novel process defined herein. As Example No. I shows, with no ester in the system general overall corrosion was noted, an indication of the susceptibility of metal to corrosion in a closed system wherein the atmosphere is saturated with water. While the presence of the reaction product of dicyclohexylamine and octanoic acid in the system reduces the amount of corrosion occurring somewhat, there was a significant, unexpected improvement when the reaction product of dicyclohexylamine and heptanoic acid was used, so significant that when 0.7 weight percent of the reaction product of dicyclohexylamine and heptanoic acid was used in Example No. VI there was no corrosion on the metal test panel.

Examples Nos. II to VII were repeated, except that the heptanoic acid was replaced with an identifical amount of cyclohexane carboxylic acid. The visual appearance of the test panels at the end of each run was identical to the corresponding runs in Table No. II.

Obviously, many modifications and variations of the invention, as hereinabove set forth, can be made without departing from the spirit and scope thereof and, therefore, only such limitations should by imposed as are indicated in the appended claims.

I claim:

1. A process for inhibiting corrosion of metal surfaces in a closed system which comprises maintaining in said system a composition containing a major amount of an oleaginous vehicle and minor amounts of an oil-soluble hydrophilic cosolvent and the reaction product of substantially equimolar proportions of a dicyclohexylamine and a $C_7$ organic acid.

2. The process of claim 1 wherein said oleaginous vehicle is a petroleum hydrocarbon.

3. The process of claim 2 wherein said petroleum hydrocarbon is a paraffinic oil.

4. The process of claim 2 wherein said petroleum hydrocarbon is a naphthenic oil.

5. The process of claim 1 wherein said cosolvent is a wetting agent.

6. The process of claim 5 wherein said wetting agent is sorbitan monoleate.

7. The process of claim 1 wherein the components of said composition are present in the following amounts:

| | Weight Percent |
|---|---|
| Oleaginous Vehicle | 99.8 to 89.0 |
| Hydrophilic Cosolvent | 0.1 to 6.0 |
| Reaction Product of the Dicyclohexylamine and the $C_7$ Organic Acid | 0.1 to 5.0 |

8. The process of claim 1 wherein the components of said composition are present in the following amounts:

| | Weight Percent |
|---|---|
| Oleaginous Vehicle | 99.6 to 97.0 |
| Hydrophilic Cosolvent | 0.1 to 2.0 |
| Reaction Product of the Dicyclohexylamine and the $C_7$ Organic Acid | 0.3 to 1.0 |

9. The process of claim 1 wherein said $C_7$ organic acid is heptanoic acid.

10. The process of claim 9 wherein said heptanoic acid is obtained from the oxidation of $C_7$ aldehydes resulting from the oxonation of $C_6$ alpha olefins.

11. The process of claim 10 wherein said $C_6$ alpha olefins are obtained from the oligomerization of ethylene.

12. The process of claim 1 wherein said $C_7$ organic acid is cyclohexane carboxylic acid.

13. The process of claim 1 wherein said dicyclohexylamine is defined by the following structural formula:

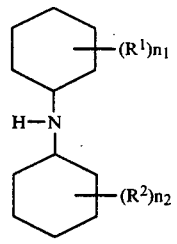

wherein $R^1$ and $R^2$ are selected from the group consisting of hydrogen, normal and branched alkyls having from 1 to 6 carbon atoms, cyclic alkyls and phenyl, and $n_1$ and $n_2$ are integers ranging from 1 to 10.

14. The process of claim 13 wherein said alkyl is methyl and $n_1$ and $n_2$ are integers ranging from 1 to 5.

15. The process of claim 13 wherein said dicyclohexylamine is dicyclohexylamine.

16. The process of claim 1 wherein said metal surface is made of steel.

17. The process of claim 16 wherein said steel is carbon steel.

18. The process of claim 1 wherein said oleaginous vehicle is a petroleum hydrocarbon, said cosolvent is a wetting agent, said component of said composition are present in the following amounts:

| | Weight Percent |
|---|---|
| Petroleum Hydrocarbon | 99.8 to 89.0 |
| Wetting Agent | 0.1 to 6.0 |
| Reaction Product of the Dicyclohexylamine and the $C_7$ Organic Acid | 0.1 to 5.0 |

said $C_7$ organic acid is heptanoic acid obtained by the oxidation of $C_7$ aldehydes resulting from the oxonation of $C_6$ alpha olefins and said metal surface is steel.

19. The process of claim 18 wherein said components of said composition are present in the following amounts:

| | Weight Percent |
|---|---|
| Petroleum Hydrocarbon | 99.6 to 97.0 |
| Wetting Agent | 0.1 to 2.0 |
| Reaction Product of the Dicyclohexylamine and the $C_7$ Organic Acid | 0.3 to 1.0 |

* * * * *